United States Patent [19]

Brown et al.

[11] 4,246,868

[45] Jan. 27, 1981

[54] ENVELOPE MACHINE GUM BOX

[75] Inventors: Richard C. Brown, Somers, Conn.; Harland S. Fisher, Longmeadow, Mass.; Theodore E. Kosciuczyk, Worcester, Mass.; Joseph M. Murphy, Wilbraham, Mass.

[73] Assignee: Westvaco Corporation, New York, N.Y.

[21] Appl. No.: 57,184

[22] Filed: Jul. 13, 1979

[51] Int. Cl.[3] ..... B05C 1/08

[52] U.S. Cl. ..... 118/694; 118/249; 118/262

[58] Field of Search ..... 250/577; 118/262, 261, 118/259, 258, 249, 694, 663, 668, 704, 696, 712

[56] References Cited

U.S. PATENT DOCUMENTS

| | | | |
|---|---|---|---|
| 571,527 | 11/1896 | Honiss et al. | 118/262 |
| 2,568,629 | 9/1951 | Heywood | 93/62 |
| 2,624,914 | 1/1953 | Rhodes | 118/259 X |
| 2,731,945 | 1/1956 | Schaefer | 118/262 X |
| 3,120,125 | 2/1964 | Vasel | 250/577 X |
| 3,339,485 | 9/1967 | Rytterholm | 118/694 X |
| 3,707,859 | 1/1973 | Carr et al. | 118/694 X |

*Primary Examiner*—John P. McIntosh

*Attorney, Agent, or Firm*—W. Allen Marcontell; Richard L. Schmalz

[57] ABSTRACT

A rotary envelope machine gum box construction is taught which provides an independent frame assembly of the meter roll and gum pond elements. The independent frame is pivotally secured to the primary machine frame at one end of the independent frame with micro-adjusting jack screw abutments at the other independent frame end. Differential adjustment of the jack screws will skew the meter roll axis to the picker roll axis. The edge line of the doctor blade may be skewed relative to the meter roll surface by push/pull screws between the independent frame and the doctor blade ends. Liquid gum is pumped from a remote supply reservoir, the gum box pond level being controlled by a fiber optic liquid level sensor which regulates the gum pump operation. Gum is delivered from the pump to a removable manifold block which distributes the gum to the pond ends for a nonstagnation zone, end-to-middle pond flow pattern. The meter roll is provided with an auxiliary drive to permit continued roll rotation during periods of primary machine drive interruption. An actuator at the jack screw end of the frame lifts the meter roll off the picker at such times of primary drive interruption.

16 Claims, 6 Drawing Figures

ENVELOPE MACHINE GUM BOX

BACKGROUND OF THE INVENTION

1. Field of the Invention

The present invention relates to envelope machines and more particularly to such machines of the rotary type wherein the operations involved in the forming of envelopes are performed in a continuous manner by the passage of material from end-to-end of the machine in rolling contact with various instrumentalities thereof.

More particularly, the present invention is directed to that mechanical equipment in an envelope machine line which performs the function of applying gum or adhesive to designated areas of the envelope blank prior to flap folding.

2. Description of the Prior Art

The generally practiced prior art technique of applying gum to precisely designated areas of an envelope blank in transit through a rotary envelope machine is to print the gum onto the blank by a rotary image transfer means called a picker as the envelope blank passes between the picker carrying roll and a backing roll. U.S. Pat. No. 2,568,629 to V. E. Heywood is representative of the prior art as presently practiced.

Gum is applied to the picker print face from the surface of a rotating metering roll in the same manner as practiced by the rotogravure arts. A portion of the rotating meter roll periphery is immersed in a viscous, fluidized gum bath. A doctor blade skims the film adhering to the meter roll surface to leave a film of gum having a precisely graduated thickness remaining on the roll surface. Continued rotation of the meter roll past the doctor blade brings the doctored gum film into contact with the print face of the picker which, by viscous fluid adhesion, picks that portion of the film off the meter roll surface onto the picker print face.

As the picker roll continues rotation past tangency with the meter roll and into tangency with a backing roll, a register aligned envelope blank is drawn into the nip between the picker and backing roll where gum on the picker print face transfers to the envelope surface.

Prior art equipment to perform the aforedescribed gum transfer function includes such features as cam adjusters on the meter roll bearings to advance and retard the meter roll surface relative to a fixed position doctor blade. However, such adjustment of the meter roll centerline also skews the meter roll and the axis thereof relative to the picker roll axis. Consequently, the picker print surfaces, which are ground about the picker roll axis, cannot run in tangential alignment with the meter roll.

From another perspective, normal wear of machine components will create an unevenness of the picker print surfaces relative to the meter roll surface. Although the same metering roll bearing cams may be adjusted to correct misalignment of the meter roll surface relative to the picker print surface, such adjustments are made at the sacrifice of meter roll alignment with the doctor blade.

Other shortcomings of prior art gum box designs relate to the rheology and viscous fluid flow characteristics of the gum substance. For example, the gum solids are dissolved in a highly volatile solvent to permit rapid drying after application to the envelope blank. However, the gum pond through which the meter roll rotates is atmospherically open thereby permitting solvent loss to the atmosphere prior to application on the envelope. To minimize the surface area of fluid gum exposed by the gum pond, small containers of such gum are manually changed and positioned invertly over the gum pond for vacuum control of the pond level. Although it is desirable to minimize the pond size, the absolute scale required for manual manipulation of a gum supply container necessitates an undesirably large pond.

Furthermore, the continuous fluid shear of the meter roll surface through the pond tends to upset and thicken the gum viscosity. Another criticism of prior art gum boxes is the flow distribution of the gum from the centrally located bottle supply. Static gum pond regions in the side corners remote from the supply bottle and opposite from the metering roll permit the gum to dry, thicken and gel, a process which progressively obstructs the entire pond flow.

All of the foregoing deficiencies of prior art gum box designs collectively collaborate when a complete stoppage of the envelope machine occurs. Rotation of the meter roll is driven by direct gear engagement with the primary machine drive. Accordingly, when the machine stops, so too does the meter roll. When the meter roll stops, gum within the gum box begins to gel thereby necessitating a complete cleanout of the gum box.

It is therefore, an objective of the present invention to provide a gum box having individual adjustments for the doctor blade relative to the meter roll and the meter roll rotation axis relative to the picker roll axis.

Another object of the present invention is to eliminate the manually exchanged, inverted bottle supply reservoir for the gum pond.

Another object of the present invention is to reduce the volumetric size and exposed surface area of the gum pond.

Another object of the present invention is to maintain the gum box volume with pumped transfer from a totally enclosed, remotely located supply reservoir.

Another object of the present invention is to maintain a closely controlled liquid level of a low volume gum pond with non-contacting level control means.

Another object of the present invention is provision of auxiliary drive power for the meter roll which continues rotation of the meter roll after and during machine stoppage.

Another object of the present invention is provision of a mechanism to safely disengage the meter roll from the picker surface to prevent injury to either during a machine stoppage while the meter roll is driven by an auxiliary power supply.

SUMMARY OF THE INVENTION

The gum box of the present invention includes a frame structure for the meter roll and doctor blade that is independent of the primary machine frame. Such independent gum box frame is pivotally secured to the primary machine frame at one machine direction end thereof. At the opposite machine direction end of the present gum box frame are adjustable abutment devices such as micro-adjusting jack screws on both sides thereof. Alongside the jack screws are tension springs to hold the respective corners of the frame down tightly against the jack screws. An actuator such as an air piston/cylinder is disposed between the gum box frame and machine frame at the jack screw end to selectively raise the jack screw end against the retaining spring tension. The meter roll, which is rotatively secured to the gum box frame between the opposite machine direction ends, may be axially skewed relative to the picker roll axis by a differential adjustment of the jack screws.

The doctor blade is adjustably secured to the gum box frame independent of the meter roll by means of a push/pull screw adjusting set at the jack screw frame end on opposite sides thereof. The plane of the doctor blade adjustments is in fixed parallelism with the meter roll axis but the blade edge may be skewed relative to said meter roll axis.

The drive end of the meter roll is provided with a straight spur gear drive for normal engagement with the primary machine drive. However, torque is transmitted from the spur teeth of the gear into the meter roll axle shaft through an overrunning clutch.

At the same end of the meter roll axle shaft as the primary drive spur gear is a bevel gear which is meshed with a mating bevel gear secured to a small electric motor shaft. The auxiliary drive bevel gear is also secured to the meter roll axle shaft by means of an overrunning clutch.

A machine speed sensor detects stoppage of the speed to trigger an air charge to the piston/cylinder jack thereby lifting the gum box frame at the corresponding end of the meter roll clear of the picker. Simultaneously the auxiliary drive motor is started to drive continued rotation of the meter roll while the primary drive spur gear remains stationary and partially engaged with the primary machine drive.

Gum supply is drawn from a closed, remotely located reservoir by a pump controlled by a non-contacting liquid level sensor. Such sensor comprises two, concentric fiber optic light paths which direct light onto the gum pond surface from one optical channel and receive the reflected residual through the other light path. The intensity of such reflected light controls, by means of a relay switch, the starting and stopping of the gum pump.

Such pumped gum supply is received through tubing conduit by a manifold having three discharge ports therefrom. Such gum flow discharge ports open from the manifold below the gum pond liquid surface level.

BRIEF DESCRIPTION OF THE DRAWING

Relative to the drawing wherein like reference characters designate like or similar elements throughout the several figures.

DESCRIPTION OF THE PREFERRED EMBODIMENT

Figure 1:
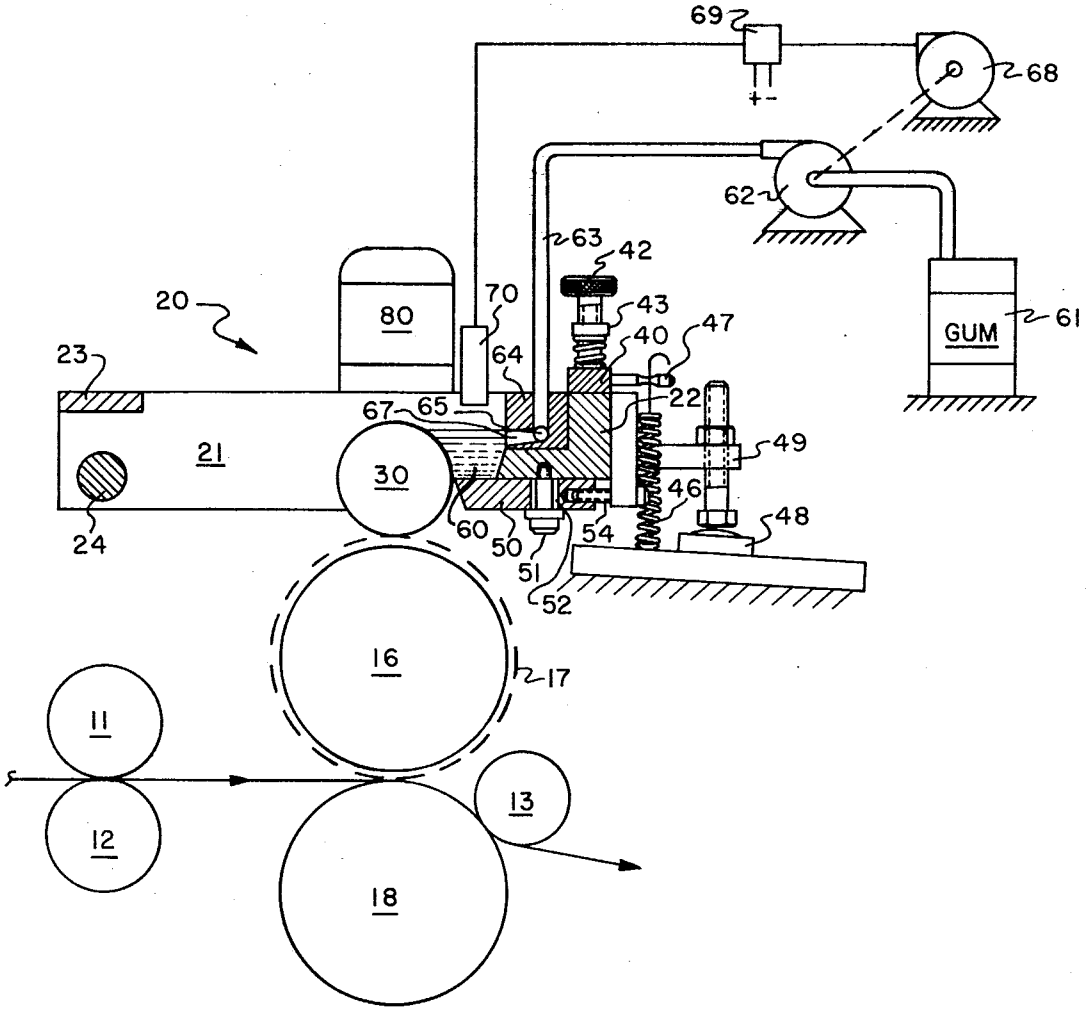
FIG. 1 is a mechanical schematic of the present invention in operative combination with a relevant portion of a rotary envelope machine. The schematic of FIG. 1 is presented as a centerline sectional elevation.
Figure 2:
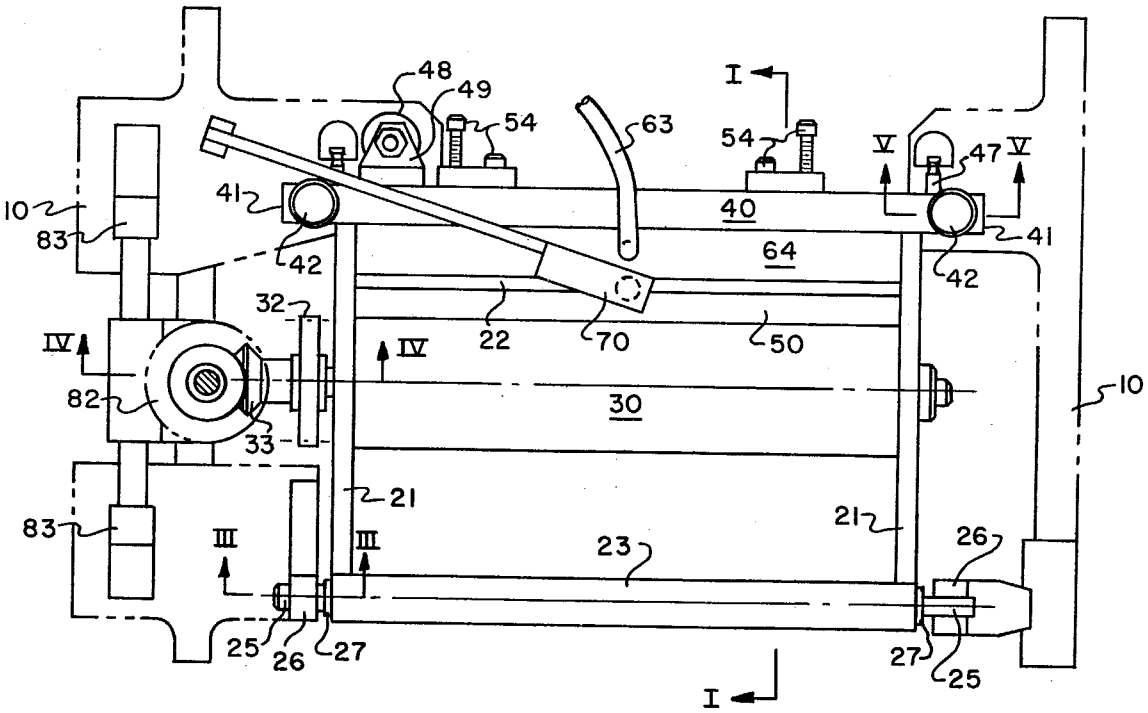
FIG. 2 is a plan view of the present invention.

Giving initial reference to FIG. 1, there is shown a centerline elevational section of a rotary envelope machine in the proximity of the blank gumming station.

Envelope blanks are advanced in registered alignment into the gumming station from a preceding folding station by the nip between forwardly rolls 11 and 12. Such folded blanks are received in registry by a nip between a backing roll 18 and a gum printing image transfer element 17 secured to a picker roll 16. Gum on the print face of the transfer element 17 is transferred to the envelope surface in the desired locations. Subsequent nip roll 13 advances the gummed blank into additional folding stations.

The present invention is focused on the gum box assembly 20 located above the picker roll 16 which has the primary function of applying a uniformly distributed gum coating of precisely metered thickness to the print face of the picker transfer element 17.

Figure 3:
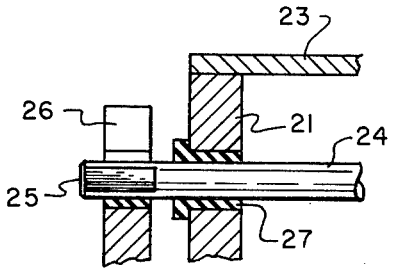
FIG. 3 is a sectioned elevational detail of the present gum box frame pivot journal as taken along sectional cut line III—III of FIG. 2.

The basic framework of the gum box comprises two longitudinal rails 21 secured together by an L-shape cross-member 22 at the downstream end and by a top strap 23 at the upstream end. Also spanning between the rails 21 at the upstream end and below the strap 23 is a mounting axle 24 having journal pins 25 at each end thereof. Relative to FIG. 3, the pins 25 socket in pedestal journals 26 secured to the machine frame 10. Sleeve bearings 27 are provided between the rails 21 and the mounting axle 24.

Figure 4:
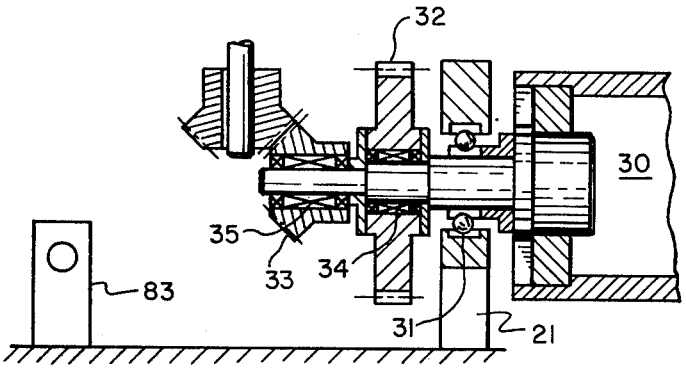
FIG. 4 is a sectioned elevational detail of the present meter roll drive as taken along sectional cut line IV—IV of FIG. 2.

Intermediate of the frame rail ends, the meter roll 30 spans through antifriction bearings 31 as shown by FIG. 4. The drive end of the meter roll 30 is provided with a spur gear 32 in alignment with the primary machine drive train and a bevel gear 33 on the shaft end. Both, spur gear 32 and bevel gear 33, have over-running clutches 34 and 35 disposed between the respective gear hubs and meter roll 30 drive shaft.

Figure 5:
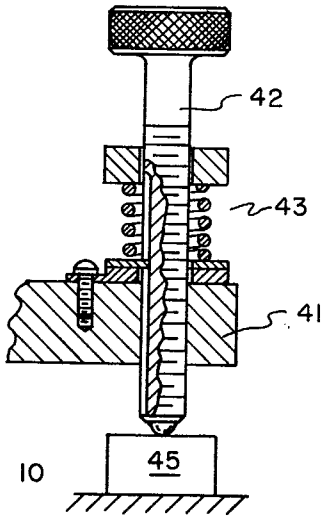
FIG. 5 is a sectional elevational detail of the present gum box frame height adjustment as taken along sectional cut line V—V of FIG. 2.

At the downstream end of the frame rails 21, a second top strap 40 is secured to the L-shaped cross-member 22 so as to include overhanging ear pieces 41. As shown in detail by FIG. 5, a threaded bore in each ear piece is made to receive micro adjustment jacks 42. A torsional locking device 43 prevents the jacks 42 from rotating during service. Hardened tips on the jack 42 ends abut against frame pedestals 45.

Holding the gum box frame firmly against the supporting pedestals 45 are tension springs 46 clipped over loading pins 47.

At the downstream end of the assembly 20, an air piston/cylinder actuator 48 is secured to the machine frame 10 and disposed opposite the lifting bracket 49 to raise the respective end of the gum box off the pedestal 45 support points against the resilient bias of the tension springs 46.

The doctor blade 50 is secured by several shoulder screws 51 to the underside of the L-shaped cross-member 22. The bore holes 52 in doctor blade 50 to receive the shank of shoulder screws 51 are of oversize diameter to permit alignment adjustment between the doctor blade edge 53 and the cylindrical surface of meter roll 30. Such adjustments are precisely controlled by a pair of push/pull adjustment screws 54 near opposite ends (machine sides) of the doctor blade.

Gum is delivered into the gum pond region 60 from a reservoir 61 and pump 62 via a supply conduit 63 connected to a distribution manifold 64. This manifold 64 is essentially a bored block having a central channel 65 supplying two end outlets 66 and a central outlet 67 which is of smaller flow diameter than the two end outlets. The outlets 66 and 67 are positioned to discharge below the surface level of gum pond 60, the predominate flow being from the end outlets 66 opposite from the meter roll ends to provide an end-to-middle gum flow pattern which minimizes the formation of static or stagnation zones within the gum pond. In the preferred elongated block configuration, the face of manifold 64 constitutes the sidewall of the gum pond 60 opposite from meter roll 30 and is unsecured to the gum box frame except for convenient vibration clamping not shown. Accordingly, the manifold 64 is adapted to be quickly and easily removed from the gum box frame for convenient and thorough periodic cleaning.

Figure 6:
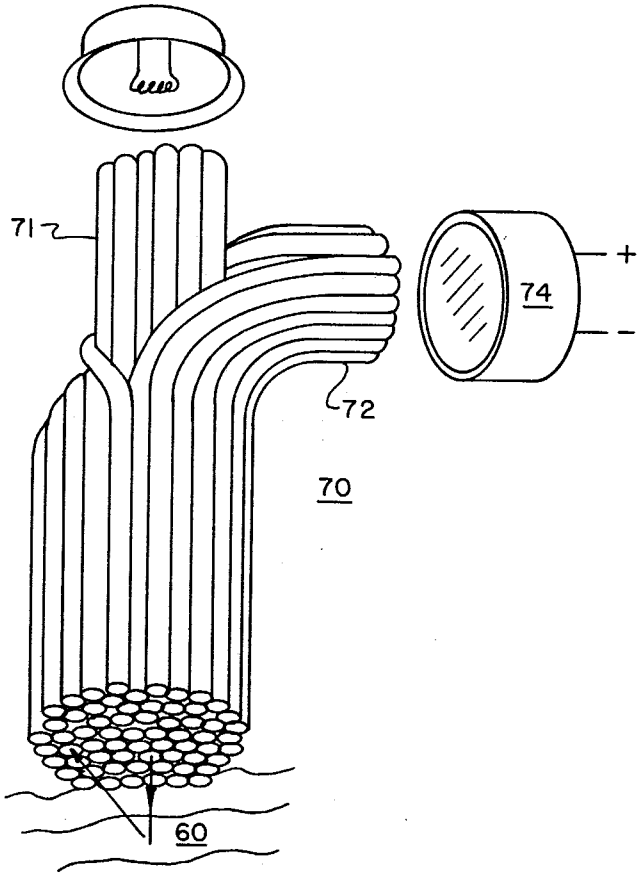
FIG. 6 is a mechanical schematic of the present fiber-optic, non-contacting, liquid level control sensor for the present invention.

Operation of the gum pump 62 is coordinated to the liquid level of the gum pond by means of a non-contacting photo-proximity sensor unit 70. Relative to the detail of FIG. 6, such a sensor comprises two concentric bundles of optic fibers 71 and 72. The inner fiber bundle 71 transmits light from a convenient source, a light emitting diode for example, to the surface of gum pond 60 and partially reflected back into the outer fiber bundle 72. The outer fiber bundle carries the reflected light to the photo-sensitive surface of a photocell 74 thereby generating a voltage proportional to the incident light energy. Relative to the schematic of FIG. 1, a photocell generated voltage in excess of a set point voltage initiates a relay 69 to interrupt power to the gum pump drive motor 68. Voltages less than a lower set point value initiate release of the relay 69 to start the gum pump motor 68. Such light intensity and consequent photocell 74 voltage variations correspond to the proximity of gum surface 60 relative to the fixed position end of the sensor unit 70. When the level falls below a predetermined point, the gum pump motor 68 starts to restore the deficiency until the level rises to a second predetermined point where the pump motor stops.

Auxiliary drive for the present invention is derived from an independently powered electric motor 80 having a bevel gear 82 on the drive shaft thereof in engagement with the meter roll bevel gear 33. To avoid adding the weight of motor 80 to that of gum box for elevation by the lift piston/cylinder 48, the motor base is secured to machine frame 10. Such an arrangement would complicate removal of the gum box for occasional cleaning except for the over-center journal mounts 83 by which the motor 80 may be pivoted completely clear of the gum box and associate gearing.

Timely starting and stopping of the auxiliary drive motor 80 may be initiated by any of several well-known mechanisms for sensing cessation of the primary machine operation. The same sensory signal may also be used to actuate the piston/cylinder 48 for lifting the meter roll 30 clear of the picker stencil 17, a distance of only 0.020 in. being sufficient.

Having fully disclosed my invention, numerous alternative mechanisms for certain components and subcombinations will readily appear to those of ordinary skill in the art. For example, the over-running clutch 35 for the auxiliary drive may alternatively be secured between bevel gear 82 and the motor shaft 81. Of course, a belt drive of meter roll 30 to place the motor 80 in another location may, in certain cases, be more suitable.

As my invention, therefore, I claim:

1. A fluid metering apparatus for a rotary image transfer roll mounted within a primary machine frame, said apparatus comprising:

Independent frame means pivotally secured to said primary machine frame about an axis that is substantially parallel with said image transfer roll;

Meter roll means rotatably secured to said independent frame means substantially parallel to said image transfer roll;

Adjustable abutment means between said primary machine frame and said independent frame means to limit the proximity of said meter roll to said image transfer roll and to adjust the parallelism between said meter roll and said image transfer roll;

Resilient bias means disposed between said independent frame means and said primary machine frame to maintain abutment contact of said abutment means;

Actuator means between said independent frame means and said primary machine frame to selectively separate said abutment means against said bias means and pivot said independent frame means about said axis thereby separating said meter roll means from said image transfer roll;

First drive means for driving said meter roll in rotational coordination with said image transfer roll;

Sensory means responsive to operational cessation of said first drive means to initiate operation of said actuator means; and Second drive means for driving said meter roll independently of said first drive means and said image transfer roll upon operational cessation of said first drive means.

2. Apparatus as described by claim 1 comprising doctor blade means slidably secured to said independent frame means, an edge of said blade means being substantially parallel with said meter roll means and push/pull adjustment means disposed at opposite ends of said blade means to adjust the parallelism of said edge with said meter roll means.

3. Apparatus as described by claim 2 comprising fluid manifold means positioned within said independent frame means spaced from said meter roll means, parallel therewith and above said doctor blade means to form one side boundary of a fluid pond between said manifold means and said meter roll means, said manifold means having one inlet port connected to a fluid pumping means and a plurality of outlet ports, at least two outlet ports being opposite from respective ends of said meter roll means.

4. Apparatus as described by claim 3 comprising non-contacting fluid level control means regulating the depth of said pond by controlling the operation of said pumping means.

5. Apparatus as described by claim 4 wherein said non-contacting fluid level control means comprises a source of light directed against the surface of said pond, reflections from said light source being received by photo-detection means, a relay switch being opened and closed as a function of the intensity of said reflected light received by said photo-detection means.

6. Apparatus as described by claim 3 wherein said manifold means is physically detachable from said independent frame means.

7. Apparatus as described by claim 1 wherein said first and second drive means comprise over-running clutch means for permitting said meter roll to be driven by alternative power sources.

8. Apparatus as described by claim 7 wherein said first and second drive means comprise first and second drive hubs, respectively said first drive hub being driven by a primary machine drive train, and said second drive hub being driven by auxiliary power means upon separation of said meter roll means from said image transfer roll.

9. Apparatus as described by claim 8 wherein said auxiliary power means is pivotally secured to said primary machine frame for drive disengagement and removal clearance for said independent frame means.

10. A gum box apparatus for a rotary envelope machine having a gum picker roll rotatively secured within a primary, envelope machine frame, said gum box comprising:

Independent gum box frame means pivotally secured to said primary machine frame about an axis that is substantially parallel to said picker roll;

Meter roll means rotatively secured to said independent frame means substantially parallel to said picker roll;

Adjustable abutment means between said primary machine frame and said independent frame means to limit the proximity of said meter roll to said picker roll and to adjust the parallelism between said meter roll and said picker roll;

Resilient bias means disposed between said independent frame means and said primary machine frame to maintain abutment contact of said abutment means;

Actuator means between said independent frame means and said primary frame to selectively pivot said independent frame means about said axis thereby separating said meter roll means from said picker roll;

Gum pond means within said independent frame means adjacent said meter roll to immerse an arcuate segment of a portion of said meter roll periphery within a fluidized pond of gum substance;

Pump means to replenish said gum pond with said gum substance;

Non-contacting level control means to maintain a predetermined pond surface level by regulating the operation of said pump means;

First drive means for driving said meter roll in rotational coordination with said image transfer roll;

Sensory means responsive to operational cessation of said first drive means to initiate operation of said actuator means; and, Second drive means for driving said meter roll independently of said first drive means and said image transfer roll upon operational cessation of said first drive means.

11. A gum box as described by claim 10 wherein said non-contacting level control means comprises means for detecting the intensity of light reflected from the surface of said pond at said prescribed level.

12. A gum box as described by claim 11 wherein said level control comprises co-axial fiber optic means to emit light onto said pond surface and receive reflections therefrom.

13. A gum box as described by claim 10 wherein said first and second drive means comprise a first hub driven by a primary drive train of said envelope machine and a second hub driven by auxiliary power means upon separation of said meter roll means from said picker roll.

14. A gum box as described by claim 13 wherein said hubs are connected to said meter roll by over-running clutch means.

15. A gum box as described by claim 10 wherein a doctor blade comprises a bottom portion of said gum pond means, said doctor blade having independent push/pull adjustment means at respective ends of said blade to adjust the parallelism of said blade with said meter roll surface.

16. A gum box as described by claim 10 wherein a removable manifold block comprises one sidewall portion of said gum pond means opposite from said meter roll, said manifold block including a gum supply port and at least two discharge ports, said discharge ports being opposite respective ends of said meter roll.

* * * * *

UNITED STATES PATENT OFFICE

CERTIFICATE OF CORRECTION

PATENT NO. : 4,246,868

DATED : January 27, 1981

INVENTOR(S) : Richard C. Brown, Harland S. Fisher, Theodore E. Kosciuczyk and Joseph M. Murphy It is certified that error appears in the above-identified patent and that said Letters Patent are hereby corrected as shown below:

Column 4, line 9, delete "forwardly" and insert therefor --forwarding--; line 26, following "the" second occurrence insert --top--. Column 5, line 63, following"motor" insert --drive--. Column 7, line 34 (Claim 10, line 21), following "primary" insert --machine--.

Signed and Sealed this

*Fourteenth* Day of *April 1981*

[SEAL]

*Attest:*

RENE D. TEGTMEYER

*Attesting Officer*

*Acting Commissioner of Patents and Trademarks*